US011505358B2

(12) United States Patent
Wang

(10) Patent No.: US 11,505,358 B2
(45) Date of Patent: Nov. 22, 2022

(54) ANTI-THEFT BOX WITH LOCK MECHANISM

(71) Applicant: Shenzhen JIPEI Green Science and Technology Limited, Shenzhen (CN)

(72) Inventor: Tom Tao Wang, Shenzhen (CN)

(73) Assignee: Shenzhen JIPEI Green Science and Technology Limited, Shenzhen (CN)

( * ) Notice: Subject to any disclaimer, the term of this patent is extended or adjusted under 35 U.S.C. 154(b) by 0 days.

(21) Appl. No.: 17/398,740

(22) Filed: Aug. 10, 2021

(65) Prior Publication Data

US 2022/0048667 A1 Feb. 17, 2022

(30) Foreign Application Priority Data

Aug. 17, 2020 (CN) ..... 202021708529.6

(51) Int. Cl.
*B65D 5/44* (2006.01)
*B65D 5/32* (2006.01)

(52) U.S. Cl.
CPC ..... *B65D 5/328* (2013.01); *B65D 5/443* (2013.01); *B65D 2401/15* (2020.05)

(58) Field of Classification Search
CPC ..... B65D 5/328; B65D 5/685; B65D 5/6608; B65D 2215/02; B65D 2215/04; B65D 2401/50
USPC ..... 229/102, 125.19–125.21, 125.23, 229/125.25–125.27, 145; 206/807; 220/345.3
See application file for complete search history.

(56) References Cited

U.S. PATENT DOCUMENTS 1,130,271 A * 3/1915 Hammond ..... B65D 5/685 206/815
2,412,798 A * 12/1946 Blackman ..... B65D 5/2033 229/109
2,579,346 A * 12/1951 Theander ..... B65D 5/685 229/173
4,208,954 A * 6/1980 Chase ..... B65D 5/685 229/110
5,040,722 A * 8/1991 Fromion ..... B65D 5/6667 229/148

(Continued)

FOREIGN PATENT DOCUMENTS

CN 212172883 U 12/2020
EP 524400 A1 * 1/1993 ..... B65D 5/20

*Primary Examiner* — Nathan J Newhouse
*Assistant Examiner* — Phillip D Schmidt
(74) *Attorney, Agent, or Firm* — Barlow, Josephs & Holmes, Ltd.; David R. Josephs

(57) ABSTRACT

The present invention has particular applicability for packaging products and relates to an anti-theft box with a lock mechanism that includes an inner box, with an opening at the first end, a cover plate at the second end and a limiter on the outer wall, and the first end is opposite to the second end; and an outer box. The outer box forms a space, the inner box is installed in this space, the cover plate is outside this space, a locating part is installed on the inner wall of the outer box, and the limiter and the locating part are used in combination to prevent the inner box from being separated from the outer box. The advantage of the present invention is that the safety device in the anti-theft box must be opened to open the anti-theft box to confirm whether the box has been opened.

7 Claims, 3 Drawing Sheets

(56) References Cited

U.S. PATENT DOCUMENTS

| | | | | |
|---|---|---|---|---|
| 5,291,995 | A * | 3/1994 | von Agris | B65D 5/4208 206/467 |
| 6,296,175 | B1 * | 10/2001 | Dixon | B65D 5/685 229/102 |
| 7,726,552 | B2 * | 6/2010 | Chadima | B65D 5/685 232/1 D |
| 2019/0061992 | A1 * | 2/2019 | Miller | B65D 5/5445 |

* cited by examiner

ANTI-THEFT BOX WITH LOCK MECHANISM

BACKGROUND OF THE INVENTION

The present invention relates generally to packaging products and relates, more specifically, to an anti-theft box with a lock mechanism.

In the express industry, box is of great importance as a packaging carrier.

However, existing boxes are mostly shaped using glue, adhesive tape or binding needle without any safety device or mechanism, so it cannot be determined whether they have been opened and it is unsafe to transport valuables or personal belongings. Besides, most boxes are locked using a plastic part or an adhesive sticker, which is hard for garbage sorting and garbage collection and unsuitable for the future trend of environmental protection.

SUMMARY OF THE INVENTION

The present invention provides an anti-theft box with a lock mechanism in light of the shortcomings of existing technologies. The safety device in the anti-theft box must be opened to open the anti-theft box to confirm whether the box has been opened.

To serve this purpose, the anti-theft box of the present invention provides technical features that are advantageous over prior art devices. The anti-theft box of the present invention includes a lock mechanism that includes an inner box, with an opening at the first end, a cover plate at the second end and a limiter on the outer wall, with the first end being opposite to the second end.

The outer box forms a space into which the inner box is installed. The cover plate is outside of this space, a locating part is installed on the inner wall of the outer box, and the limiter and the locating part are used in combination to prevent the inner box from being separated from the outer box.

The locating part is a groove on the inner wall of the outer box where the locating part preferably is a dented edge on the inner wall of the outer box that extends into the cavity. The limiter is a limiting piece, and the limiting piece and the outer wall of the inner box form an inclined angle of 0° to 90°.

The inner box includes the first framework and the second framework. The second framework is fixed on the first framework and the limiter is on the outer wall of the second framework.

The cover plate, the first framework, the second framework and the outer box are preferably made of binding board. The cover plate is bound to the inner box.

The limiter is set on the outer walls around the inner box and a locating part is set on the inner walls around the outer box accordingly. And the limiter is preferably made of paper.

The first framework is a rectangular structure and the second framework is also preferably a rectangular structure.

The anti-theft box of the present invention has many benefits over prior art devices. The limiter is set on the outer wall of the inner box, a locating part is set on the inner wall of the outer box and the limiter and the locating part cooperate with each other to form a lock mechanism in the anti-theft box. The safety device in the anti-theft box must be opened to open the anti-theft box to confirm whether the box has been opened. An opening is formed at the first end of the inner box, the inner box is in the space of the outer box, and the first end is closed to prevent shrinkage of the space.

A cover plate is set at the second end of the inner box and outside the space to prevent the inner box from falling into the outer box and coming into contact with the bottom wall of the outer box. The anti-theft box is be easy to operate to install the inner box and the outer box. While unpacking the anti-theft box, it is be easy to apply a force to the cover plate to extract the inner box out of the outer box. The inclined angle between the limiting piece and the outer wall of the inner box is set as 0° to 90° to separate the limiter from the locating part by applying a certain force, in order to avoid damaging the limiter on the inner box by accident.

The cover plate, the first framework, the second framework and the outer box are made of binding board for better deflection of the anti-theft box and better protection performance than ordinary boxes. A limiter is set on the outer walls around the inner box and a locating part is set on the inner walls of the outer box to apply a uniform force to the limiters, avoid damaging the paper limiters when the anti-theft box is placed upside down and improve tightness of the inner box installed in the outer box.

The limiter is preferably made of paper for two reasons. On one hand, the limiter will be damaged when the anti-theft box is maliciously unpacked by others so that the user can confirm whether the box has been opened; on the other hand, paper limiter is conducive to garbage sorting and garbage collection and it improves environmental protection property of the anti-theft box.

BRIEF DESCRIPTION OF THE DRAWING FIGURES

Further advantages, features and possible applications of the present invention will be described in the accompanying drawing figures in which.

DESCRIPTION OF THE INVENTION

Examples of this invention are described in detail as below and are shown in the attached drawings, in which identical or similar marks represent identical or similar components or components with identical or similar functions. The following examples described through reference to the attached drawings are illustrative and used to explain the present invention and they cannot be construed as the limitations thereof.

It should be understood in the description herein that the terms "length", "width", "up", "down", "front", "back", "left", "right", "vertical", "horizontal", "top", "bottom", "inside" and "outside" azimuth or position relations indicated should be azimuth or position relations indicated based on the attached drawings, which are used to describe this invention and simplify the description only instead of indicating or implying that the indicated devices or components must have specific azimuths and be constructed and operated in specific azimuths. Thus, they cannot be construed as the limitations of the present invention.

Besides, the terms "first" and "second" are used for description only and they cannot be construed as indicating or implying relative importance or implying the quantity of the technical characteristics indicated. Therefore, the characteristics prefixed with "first" or "second" can explicitly or implicitly contain one or more such characteristics. In the description herein, "several" means two or more, unless otherwise explicitly defined.

In the examples of the present invention, unless otherwise explicitly specified and defined, the terms "install", "link", "connect" and "fix" should be interpreted broadly, e.g.: fixed connection, detachable connection or integrated connection; or mechanical connection or electrical connection; or direct connection, or indirect connection by media, or interconnection of two components or interaction between two components. For ordinary technical personnel of this field, the concrete meaning of the aforesaid terms can be interpreted as appropriate.

Figure 1:
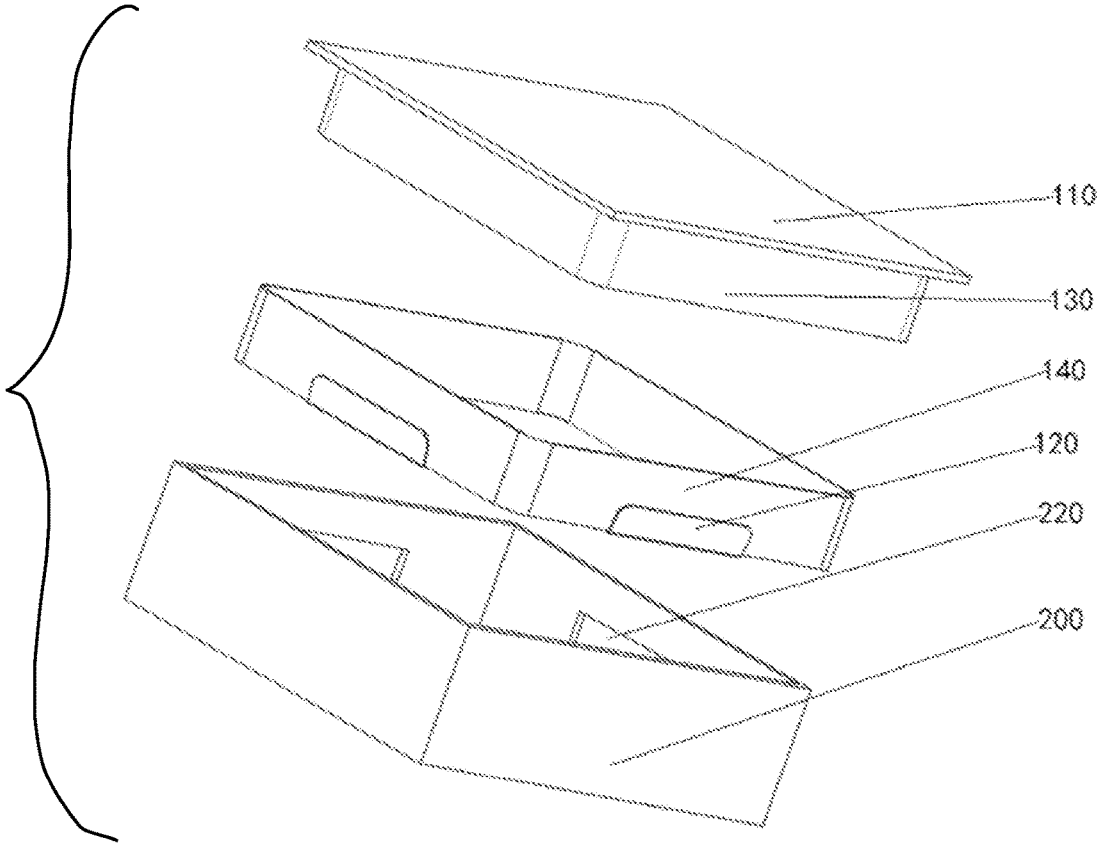
FIG. 1 is an exploded perspective view of a first embodiment of the present invention.
Figure 2:
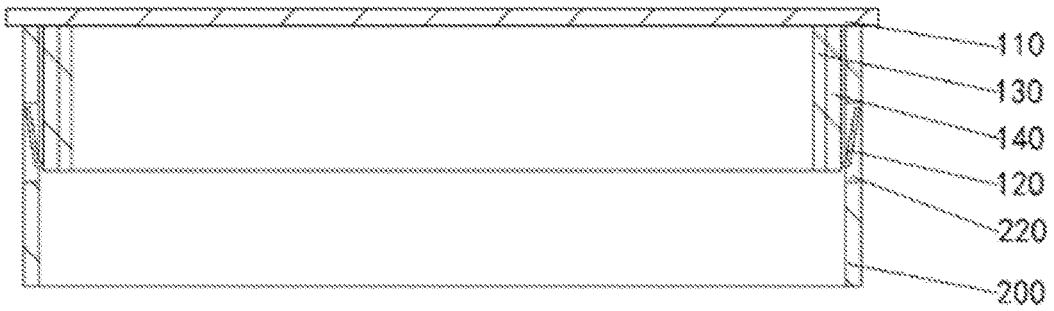
FIG. 2 is a cross-sectional view of the embodiment of FIG. 1.

Referring first to FIGS. 1 and 2, an anti-theft box with a lock mechanism is shown to include an inner box 100, with an opening at the first end, a cover plate 110 at the second end and a limiter 120 on the outer wall, and the first end is opposite to the second end with the outer box 200 forming a space. In this space, an opening is set at an end of outer box 200 so that the inner box 100 can be installed in this space. The cover plate 110 is outside this space, a locating part is installed on the inner wall of the outer box 200, and the limiter 120 and the locating part are used in combination to prevent the inner box 100 from being separated from the outer box 200. In this example, the locating part is a groove 220 on the inner wall of the outer box 200.

Figure 3:
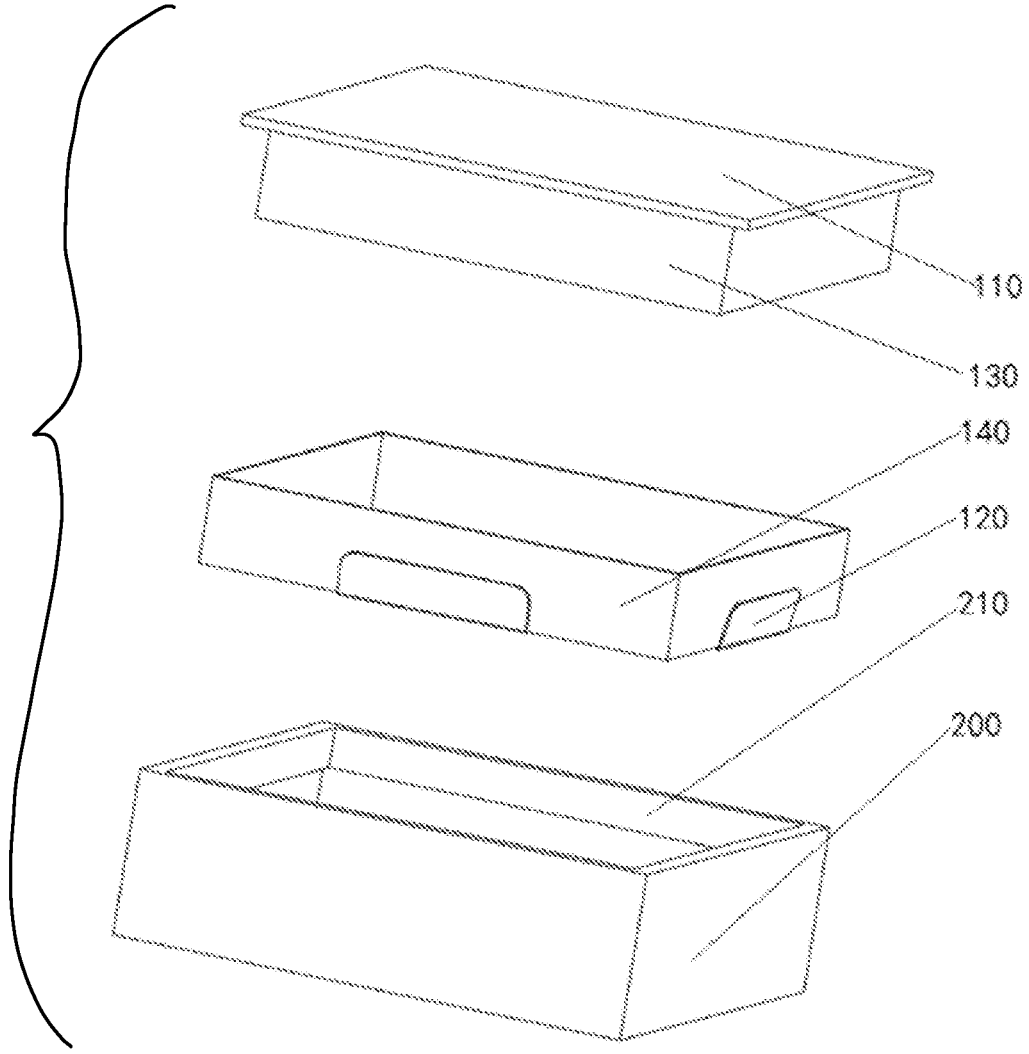
FIG. 3 is an exploded perspective view of a second embodiment of the present invention.
Figure 4:
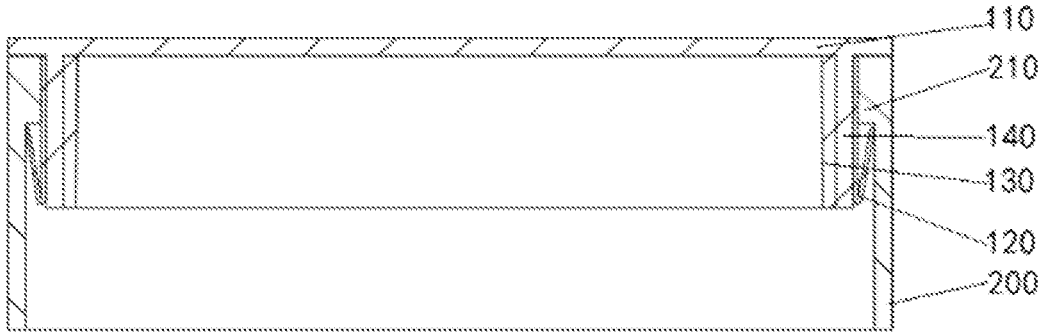
FIG. 4 is a cross-sectional view of the embodiment of FIG. 2.

Referring now to FIGS. 3 and 4, a second embodiment of the present invention is shown, which is different from the first embodiment of FIGS. 1 and 2 in that the locating part is a dented edge 210 on the inner wall of the outer box 200 that extends into the cavity. In the above embodiment, limiter 120 is a limiting piece and the limiting piece and the outer wall of the inner box 100 form an inclined angle of 0° to 90°.

Figure 5:
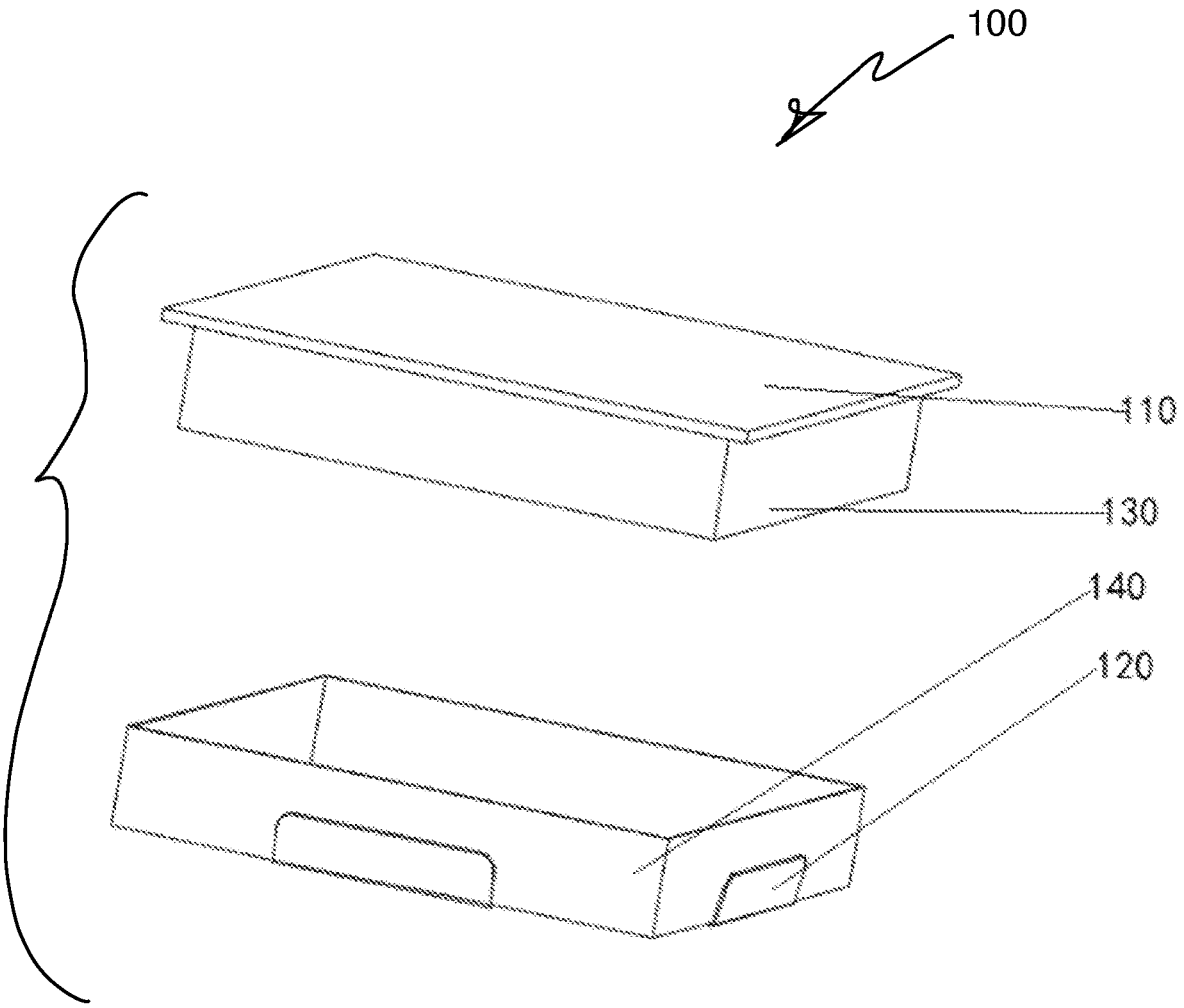
FIG. 5 is an exploded perspective view of the inner box of the present invention.

As seen in FIG. 5, in the above example, the inner box 100 includes the first framework 130 and the second framework 140, the second framework 140 is fixed on the first framework 130 and the limiter 120 is on the outer wall of the second framework 140. Where, the cover plate 110, the first framework 130, the second framework 140 and the outer box 200 are preferably made of binding board. The first framework 130 is preferably a rectangular structure and the second framework 140 is also a rectangular structure. In accordance with the present invention, the cover plate 110 is bound to the inner box 100. In use, the outer wall of the first framework 130 is preferably coated with glue, the second framework 140 is set on the first framework 130, the second end of the integrated framework is preferably coated with glue and the cover plate 110 is fixed on the second end of the framework.

In the above embodiment, a limiter 120 is set on the outer walls of the inner box 100 and a limiting part is set on the inner walls of the outer box 200. The limiter 120 may also be set on one, two or more outer walls of the inner box 100 and the inner walls corresponding to the outer box 200 accordingly. The limiter 120 is preferably made of paper.

For use of the present invention, the inner box 100 is placed in the outer box 200 and the limiter 120 on the outer wall of the inner box 100 and the locating part on the inner wall of the outer box 200 cooperate with each other so that the inner box 100 and the outer box 200 are fixed. When the inner box 100 is extracted, the limiter 120 is connected to the side wall of the locating part to avoid extracting the inner box 100 out of the outer box 200. The inner box 100 can be extracted only when a certain force is applied and the limiter 120 is damaged.

The aforesaid examples are only one of the optimal modes of execution of the present invention and common changes and substitutes made by technical personnel of this field within the technical proposal of this invention should be included in the protection scope thereof. It would be appreciated by those skilled in the art that various changes and modifications can be made to the illustrated embodiments without departing from the spirit of the present invention. All such modifications and changes are intended to be covered by the appended claims.

What is claimed is:

1. An anti-theft box with a lock mechanism, comprising:

an inner box, with an opening at the first end, a cover plate at the second end and a limiter, made of paper, and the first end is opposite to the second end; the inner box including a first framework and a second framework; the second framework being fixed on the first framework and the limiter being on the outer wall of the second framework;

an outer box, which forms a space, the inner box being installed in the space, the cover plate being outside this space, a locating part is installed on the inner wall of the outer box and the limiter and the locating part are used in combination to prevent the inner box from being separated from the outer box; and the cover plate, the first framework, the second framework and the outer box being made of binding board.

2. The anti-theft box of claim 1, wherein the locating part is a groove on the inner wall of the outer box.

3. The anti-theft box of claim 1, wherein the locating part is a dented edge on the inner wall of the outer box that extends into the cavity.

4. The anti-theft box of claim 1, wherein the limiter is a limiting piece, and the limiting piece and the outer wall of the inner box form an inclined angle of 0° to 90° .

5. The anti-theft box of claim 1, wherein the limiter is set on the outer walls around the inner box and a locating part is set on the inner walls around the outer box.

6. The anti-theft box of claim 5, wherein the first framework is a rectangular structure and the second framework is also a rectangular structure.

7. The anti-theft box of claim 1, wherein the cover plate is bound to the inner box.

* * * * *